US011088493B2

(12) United States Patent
Yoshida

(10) Patent No.: US 11,088,493 B2
(45) Date of Patent: Aug. 10, 2021

(54) LEVER-TYPE CONNECTOR

(71) Applicant: Sumitomo Wiring Systems, Ltd., Yokkaichi (JP)

(72) Inventor: Yutaro Yoshida, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/832,011

(22) Filed: Mar. 27, 2020

(65) Prior Publication Data

US 2020/0313351 A1 Oct. 1, 2020

(30) Foreign Application Priority Data

Mar. 28, 2019 (JP) ..... JP2019-063513

(51) Int. Cl.
*H01R 13/629* (2006.01)

(52) U.S. Cl.
CPC . *H01R 13/62955* (2013.01); *H01R 13/62938* (2013.01)

(58) Field of Classification Search
CPC ..... H01R 13/62938; H01R 13/62955
USPC ..... 439/157
See application file for complete search history.

(56) References Cited

U.S. PATENT DOCUMENTS 5,709,560 A * 1/1998 Hio ..... H01R 13/62933 439/157
5,975,928 A * 11/1999 Tsuji ..... H01R 13/62938 439/157
7,670,159 B2 * 3/2010 Shamoto ..... H01R 13/62938 439/157
8,215,970 B2 * 7/2012 Shamoto ..... H01R 13/5213 439/157
2003/0190836 A1 * 10/2003 Yamashita ..... H01R 13/62938 439/489
2006/0228921 A1 * 10/2006 Fukui ..... H01R 13/62955 439/157
2007/0099461 A1 * 5/2007 Pittenger ..... H01R 13/62977 439/157
2012/0302086 A1 * 11/2012 Oiri ..... H01R 13/62944 439/372
2013/0065412 A1 * 3/2013 Ikeda ..... H01R 13/62938 439/157
2016/0285200 A1 * 9/2016 Eow ..... H01R 13/62955
2019/0027858 A1 * 1/2019 Goto ..... H01R 13/52
2019/0027863 A1 * 1/2019 Nishii ..... H01R 13/62938

FOREIGN PATENT DOCUMENTS

JP 08-185925 7/1996

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A lever-type connector (1) is provided with a connector housing (10) including a wire holding portion (11). Wires W have end parts held in the wire holding portion (11) and extend from the connector housing (10). A lever (20) is assembled with the connector housing (10) and is rotatable from a connection start position to a connection end position. A cover (50) covers the wires W extending from the connector housing (10) by being assembled with the connector housing (10). The cover 50 includes positioning portions (55A), and the lever (20) includes positioning receiving portions for positioning the cover (50) at a proper mounting position by contacting the positioning portions (55A) when the lever (20) is at the connection end position.

11 Claims, 12 Drawing Sheets

LEVER-TYPE CONNECTOR

BACKGROUND

Field of the Invention

This specification relates to a lever-type connector.

Related Art

A lever-type connector includes a lever with a cam mechanism. The lever-type connector and a mating connector can be connected easily and with a small force by a cam action associated with rotation of the lever from a connection start position to a connection end position.

Japanese Unexamined Patent Publication No. H08-185925 discloses a lever-type connector with a cover for covering wires drawn out from a connector housing. A lever-type connector with a wire cover must smoothly complete a connecting operation while suppressing misalignment of the cover with respect to the connector housing.

SUMMARY

This specification relates to a lever-type connector with a connector housing that includes a wire holding portion. A wire extends from the connector housing and has an end part held in the wire holding portion. A lever is assembled with the connector housing and is rotatable from a connection start position to a connection end position. A cover is assembled with the connector housing for covering the wire extending from the connector housing. The cover includes a positioning portion, and the lever includes a positioning receiving portion for positioning the cover at a proper mounting position by contacting the positioning portion when the lever is at the connection end position.

If the cover of a lever-type connector is misaligned with respect to the connector housing, the lever may not be held at the predetermined connection end position, and a connecting operation may not be completed smoothly due interference of the cover with the lever. However, according to the above configuration, if the lever is rotated to the connection end position, the positioning portion contacts the positioning receiving portion so that the cover is positioned at the proper mounting position. In this way, the lever is held at the predetermined connection end position, and the connecting operation can be completed smoothly.

The lever may include a lock, and the cover may include a lock receiving portion to be locked by the lock. However, the lock and the lock receiving portion may be misaligned and cannot be locked to each other if the cover is misaligned with respect to the connector housing. As a result, it may not be possible to complete the connecting operation. On the other hand, the above-described lever-type connector has the positioning portion and the positioning receiving portion for positioning the cover so that the connecting operation can be completed smoothly.

The cover may have an accommodation recess that receives the lock inside when the lever is at the connection end position. Thus, a projecting amount of the lever from the cover at the connection end position can be reduced, and the entire lever-type connector can be smaller as compared to the case where the cover has no accommodation recess.

The cover may include a bent holding portion for holding the wire in a bent state. A cover that holds the wire in the bent state is misaligned easily due to a restoring force of the bent wire. However, the positioning portion and the positioning receiving portion for positioning the cover at the proper mounting position suppresses misalignment of the cover and enables smooth completion of the connecting operation.

The positioning portion may be a reinforcing rib projecting from an outer surface of the cover. The reinforcing rib on the cover can perform the positioning function without a drastic design change of the cover.

The positioning receiving portion may be an inner surface of a lightening hole recessed from a surface of the lever. The lightening hole is provided for preventing deformation when the lever is formed by injection molding and can be used as the positioning receiving portion without a drastic design change of the lever.

The positioning receiving portion may have a first contact surface configured to contact the positioning portion when the lever is at the connection end position and a second contact surface arranged perpendicular to the first contact surface and configured to contact the positioning portion when the lever is at the connection end position. According to this configuration, misalignment of the cover can be suppressed in two directions perpendicular to each other and the misalignment is suppressed more reliably.

The lever-type connector disclosed by this specification enables a connecting operation to be completed smoothly by suppressing misalignment of the cover with respect to the connector housing.

DETAILED DESCRIPTION

A specific example of the invention is described below with reference to the drawings. However, invention is not limited to these illustrations and is intended to be represented by claims and include all changes in the scope of claims and in the meaning and scope of equivalents.

Figure 1:
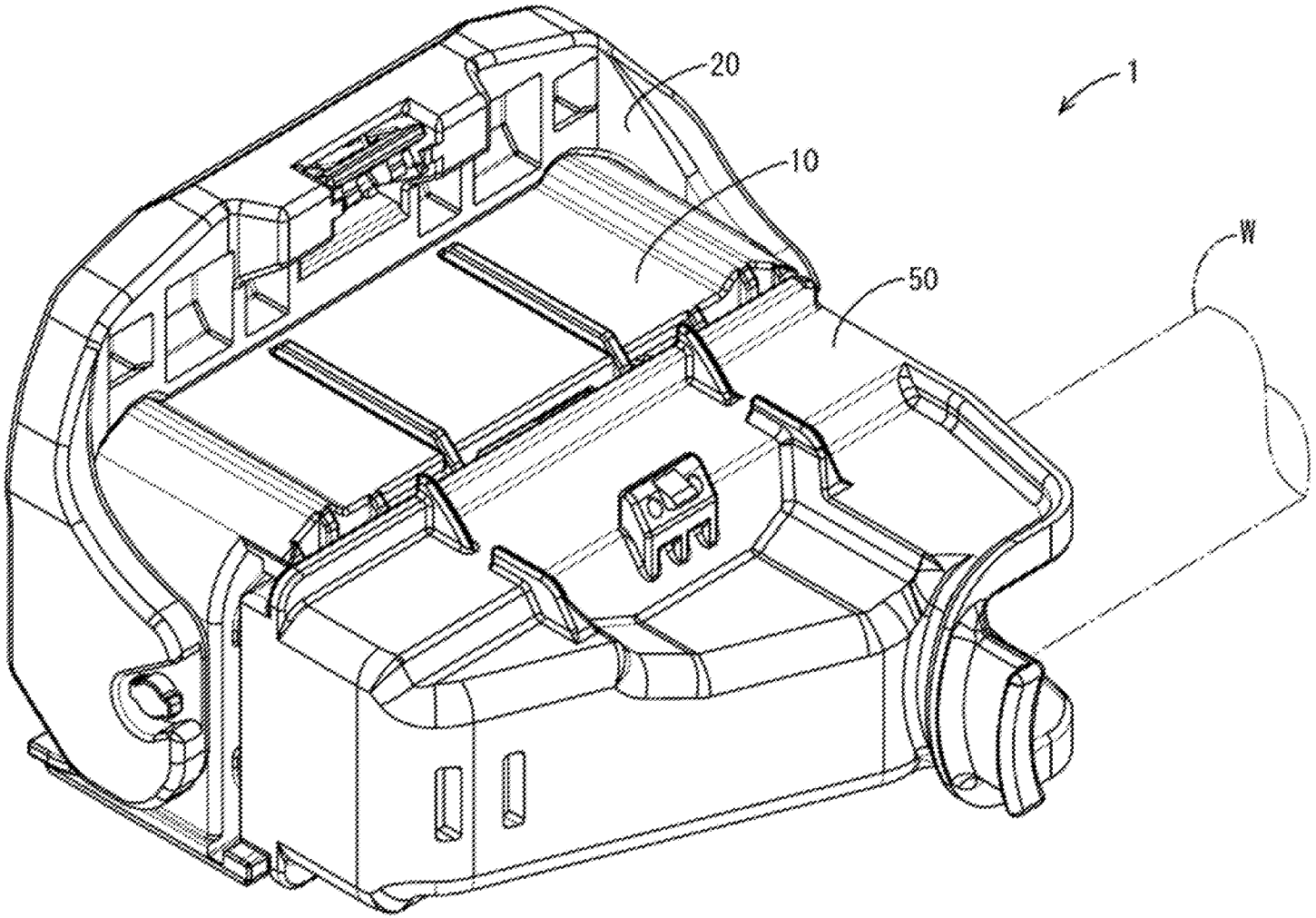
FIG. 1 is a perspective view of a lever-type connector of an embodiment.

An embodiment is described with reference to FIGS. 1 to 12. A lever-type connector 1 of this embodiment is to be connected to a mating connector 60 that has cam followers 62. As shown in FIG. 1, the lever-type connector 1 includes a connector housing 10 for holding wires W, a lever 20 to be assembled with the connector housing 10 and a cover 50 to be assembled with the connector housing 10.

[Connector Housing 10]

Figure 2:
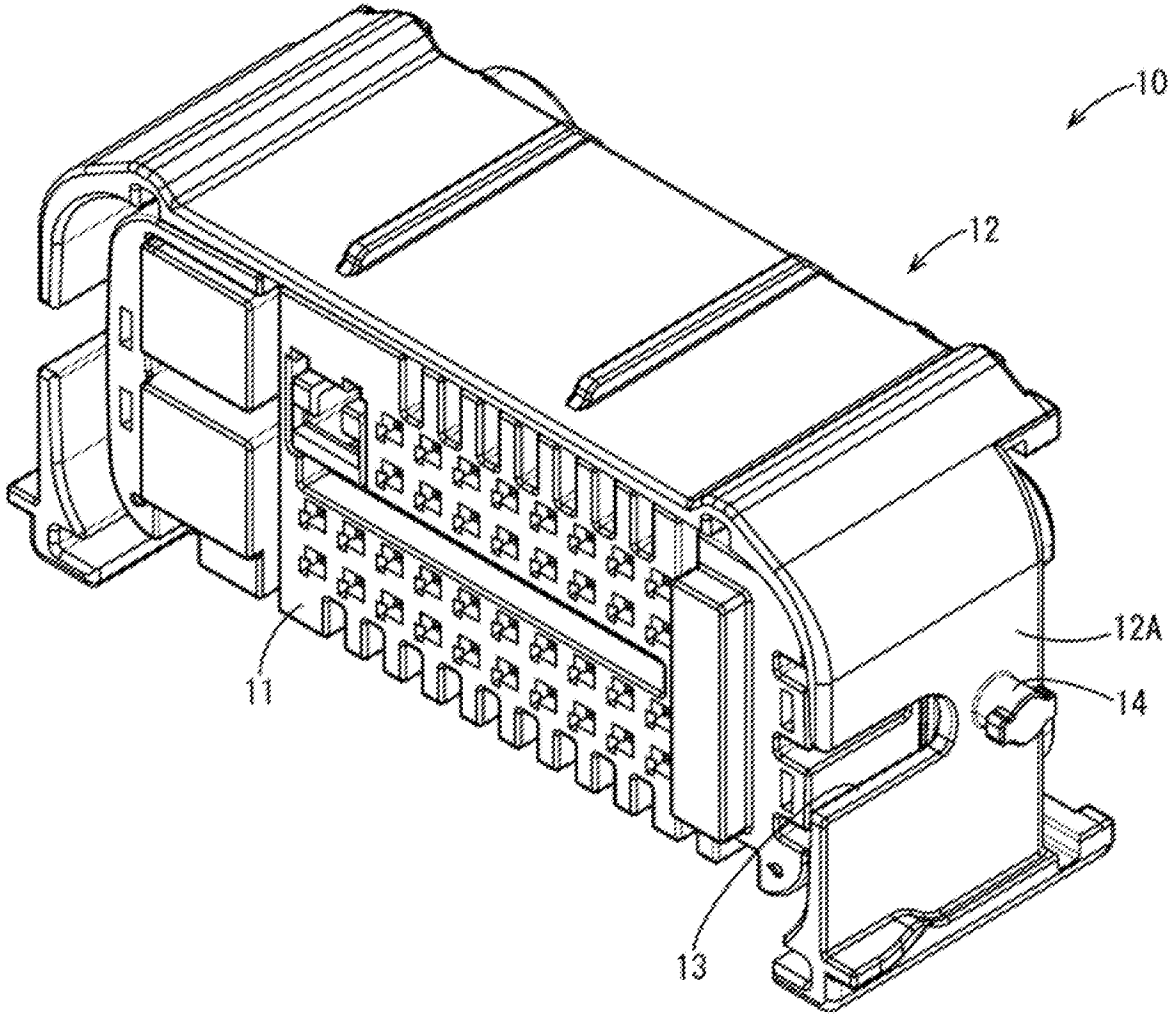
FIG. 2 is a perspective view of a connector housing of the embodiment.

The connector housing 10 is made of synthetic resin and includes, as shown in FIG. 2, a block-like wire holding portion 11 and a tubular receptacle 12 surrounding the wire holding portion 11. The wires W have end parts held in the wire holding portion 11 and extend from the connector housing 10.

Two parallel mounting walls 12A are disposed in the receptacle 12. Each mounting wall 12A includes a receiving groove 13 for receiving the cam follower 62. Further, a cylindrical support shaft 14 projects from each mounting wall 12A for rotatably supporting the lever 20.

[Lever 20]

Figure 3:
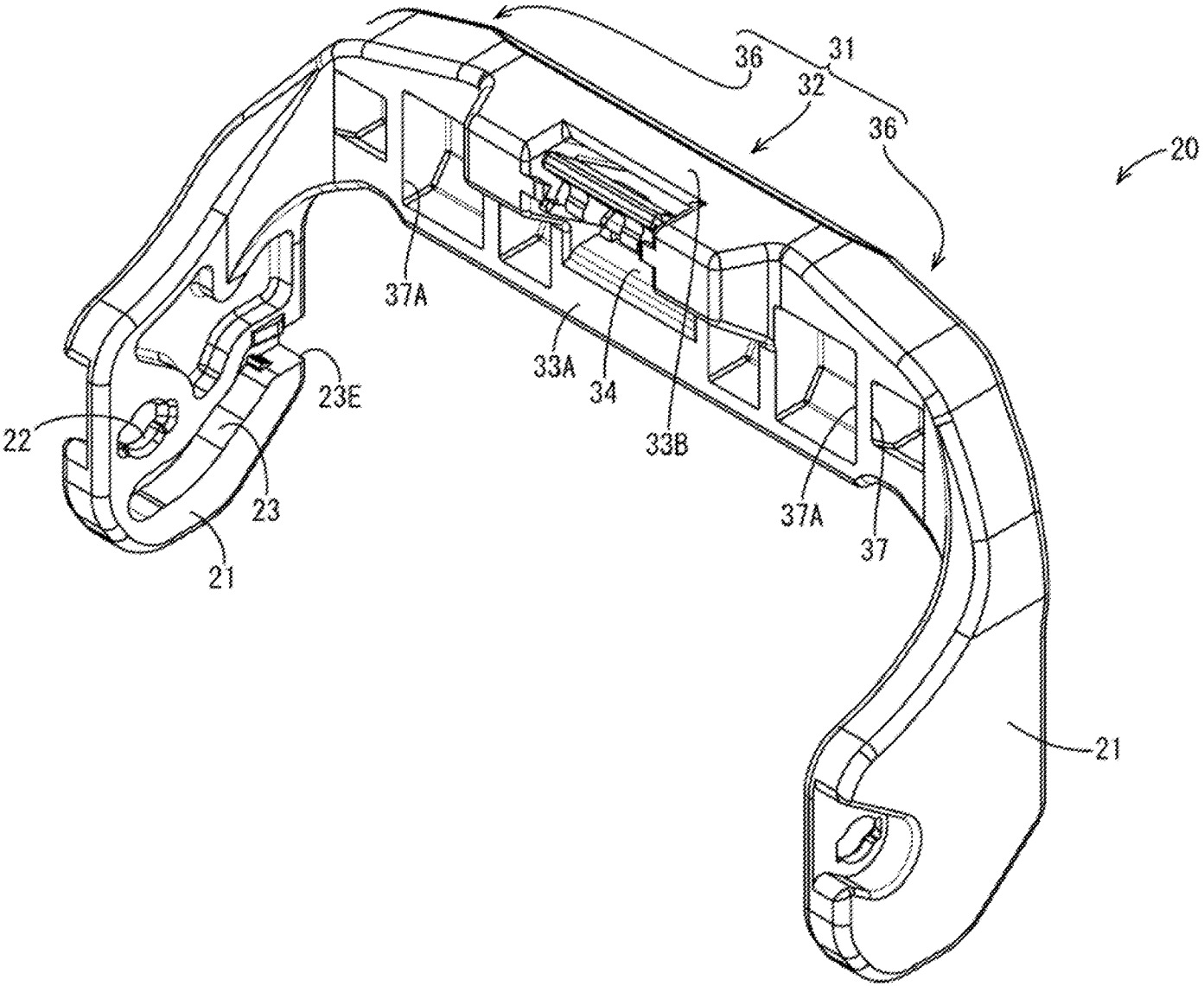
FIG. 3 is a perspective view of a lever of the embodiment.
Figure 4:
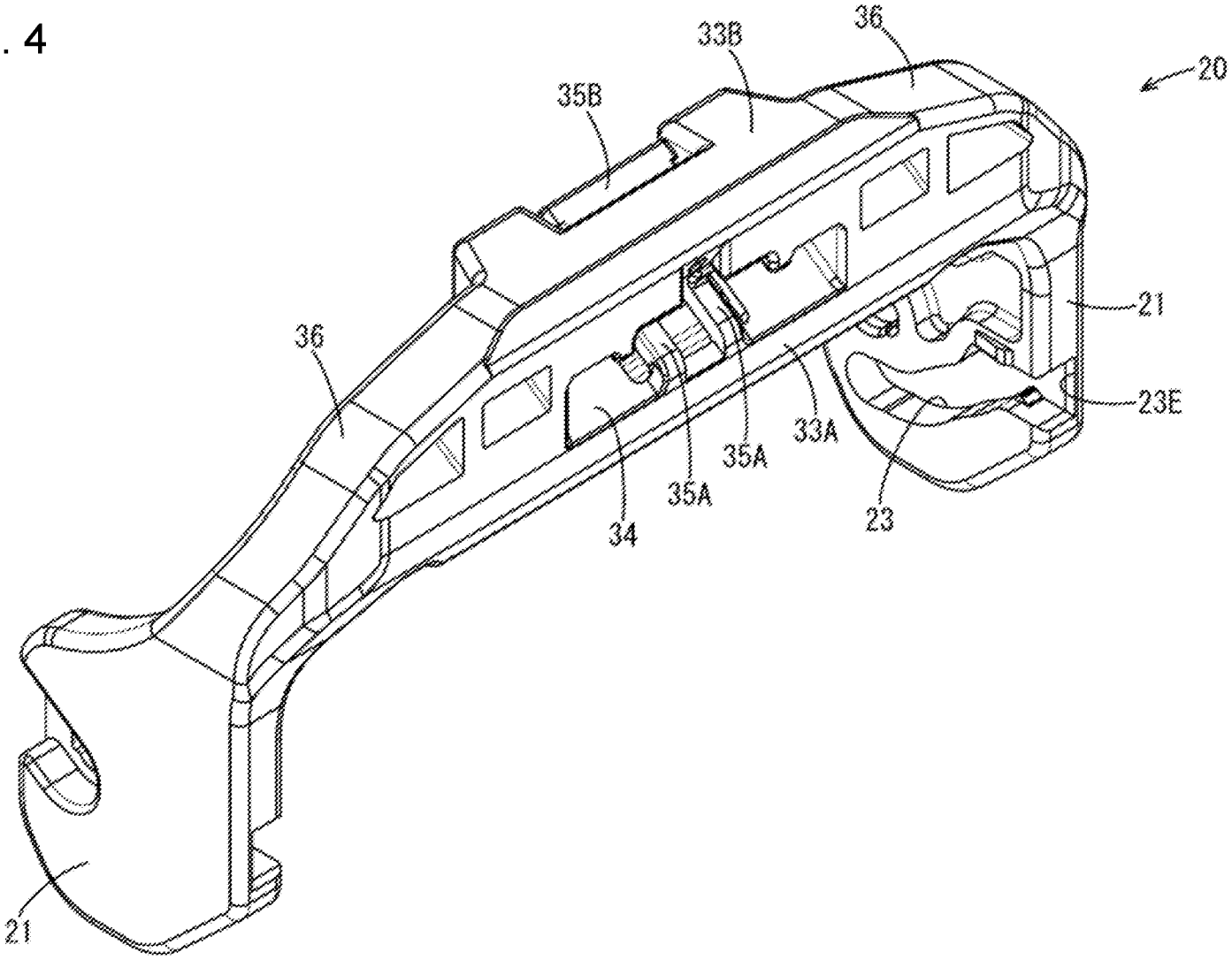
FIG. 4 is a perspective view of the lever of the embodiment viewed from a direction different from that in FIG. 3.

The lever 20 is a substantially U-shaped member made of synthetic resin and includes first and second parallel cam plates 21 arranged parallel to each other across the connector housing 10, and a rotating portion 31 couples the cam plates 21, as shown in FIGS. 3 and 4.

Each cam plate 21 is arranged along the mounting wall 12A and includes, as shown in FIG. 3, a bearing hole 22 for receiving the support shaft 14 and a cam groove 23 for receiving the cam follower 62.

The bearing hole 22 is a substantially circular hole penetrating through the cam plate 21 and defines a center of rotation of the cam plate 21. The cam groove 23 is recessed from a surface of the cam plate 21 facing the mounting wall 12A. The cam groove 23 includes an entrance 23E on one edge of the cam plate 21 for allowing the entrance of the cam follower 62 and extends toward a back side from this entrance 23E. The cam groove 23 has an arcuate shape to approach the bearing hole 22 gradually from the entrance 23E toward the back side.

As shown in FIG. 3, the rotating portion 31 includes a lock 32 and two couplings 36.

The lock 32 is at a middle position between the two cam plates 21 and is to be locked to a lock receiving portion 56 on the cover 50. The lock 32 has first and second plate-like bridges 33A, 33B and a lock arm 35.

Figure 7:
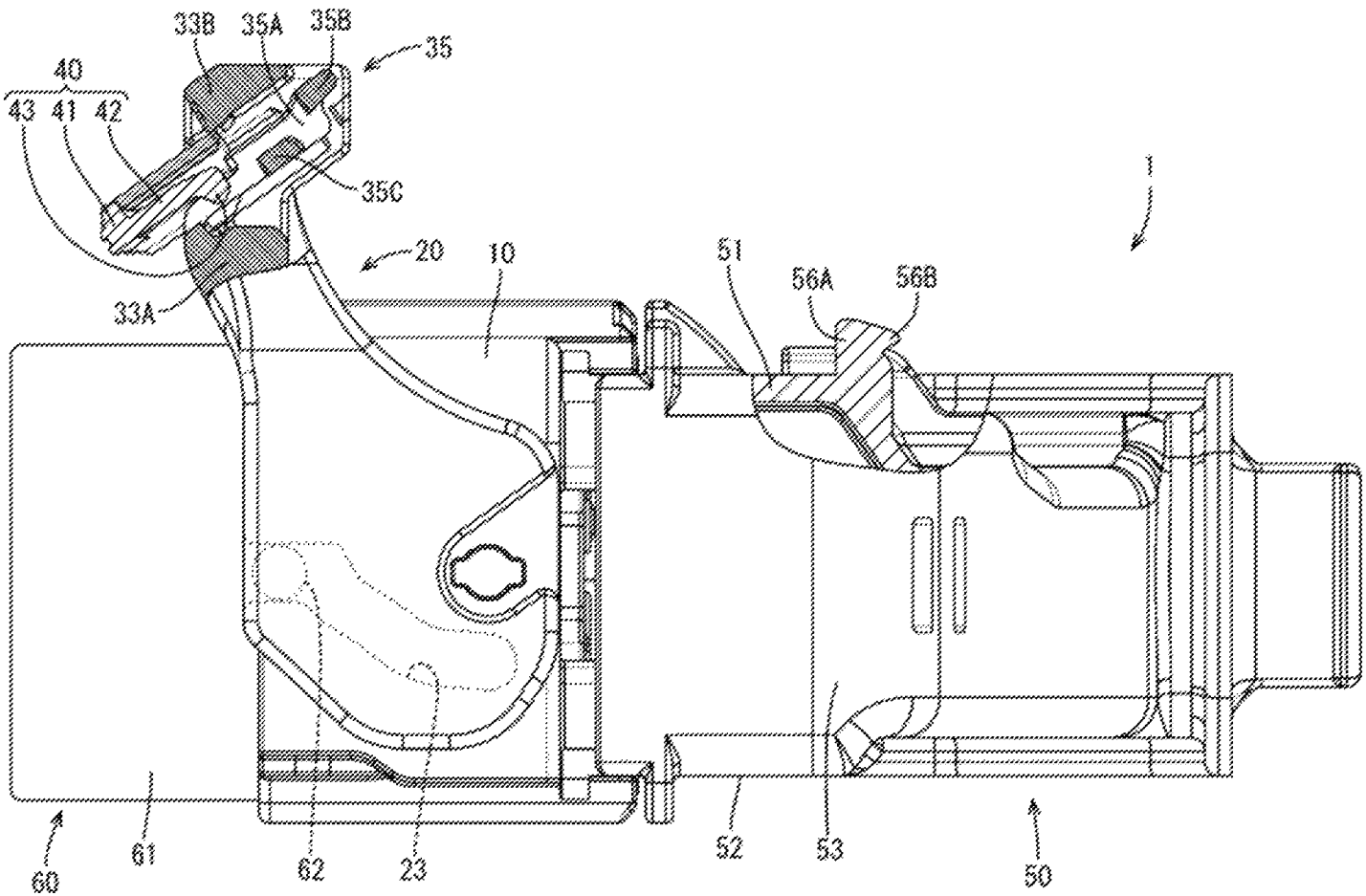
FIG. 7 is a side view partly in section along A-A of FIG. 6 showing the lever-type connector and a mating connector in an initial stage of connection in the embodiment.

The two bridges 33A, 33B are arranged at a distance from each other so that a lock space 34 is defined between the bridges 33A, 33B. As shown in FIGS. 4 and 7, the lock arm 35 includes two spaced apart arms 35A extending from the first bridge 33A and arranged at a distance from each other in the lock space 34. A locking portion 35B and a lock beam 35C link the arms 35A. The lock arm 35 is deflectable in directions toward and away from the second bridge 33B with a coupled position to the first bridge portion 33A as a base.

As shown in FIG. 3, first and second plate-like couplings 36 extend from the respective first and second bridges 33A, 33B to the respective first and second cam plates 21.

Figure 8:
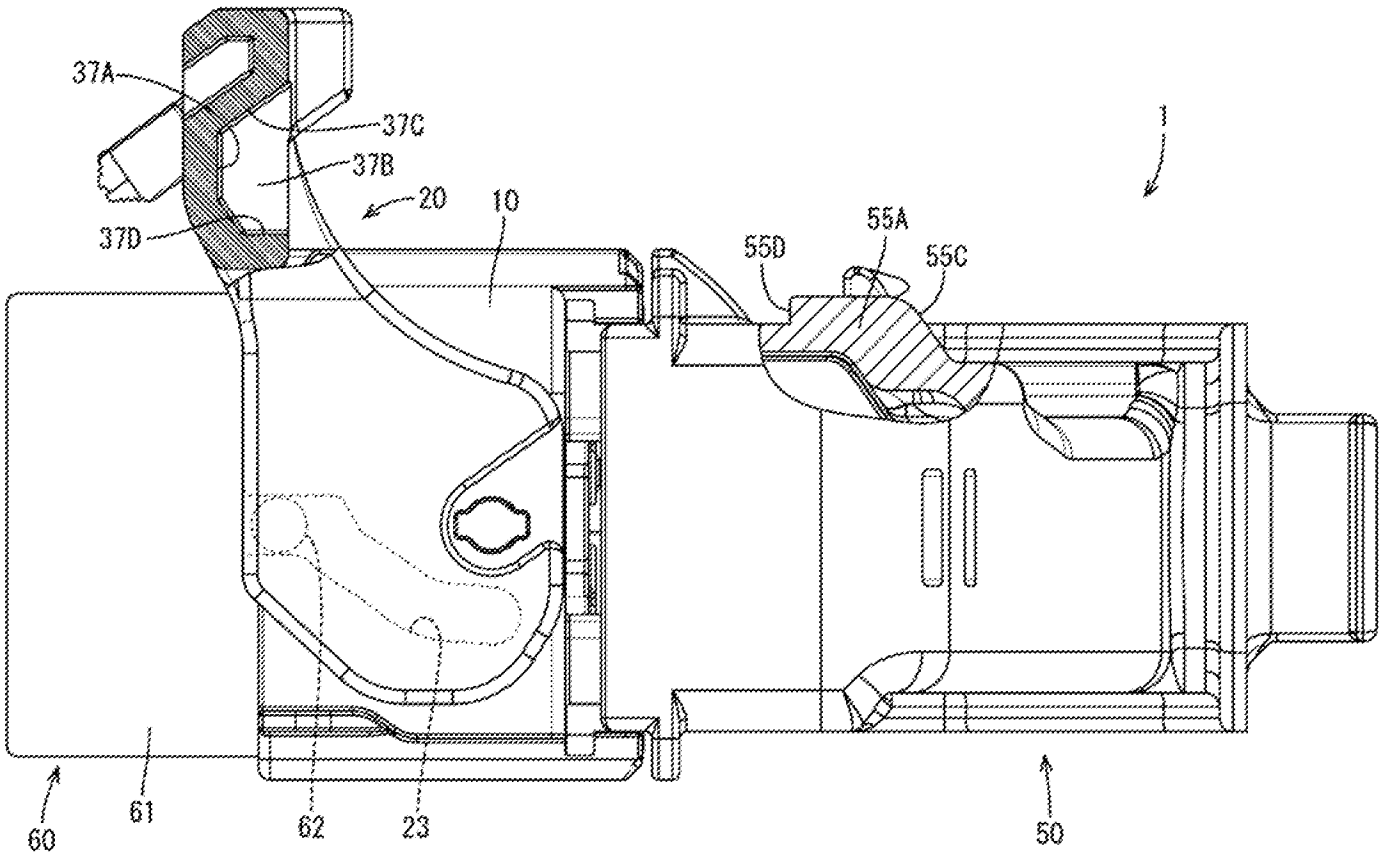
FIG. 8 is a side view partly in section along B-B of FIG. 6 showing the lever-type connector and the mating connector in the initial stage of connection in the embodiment.
Figure 9:
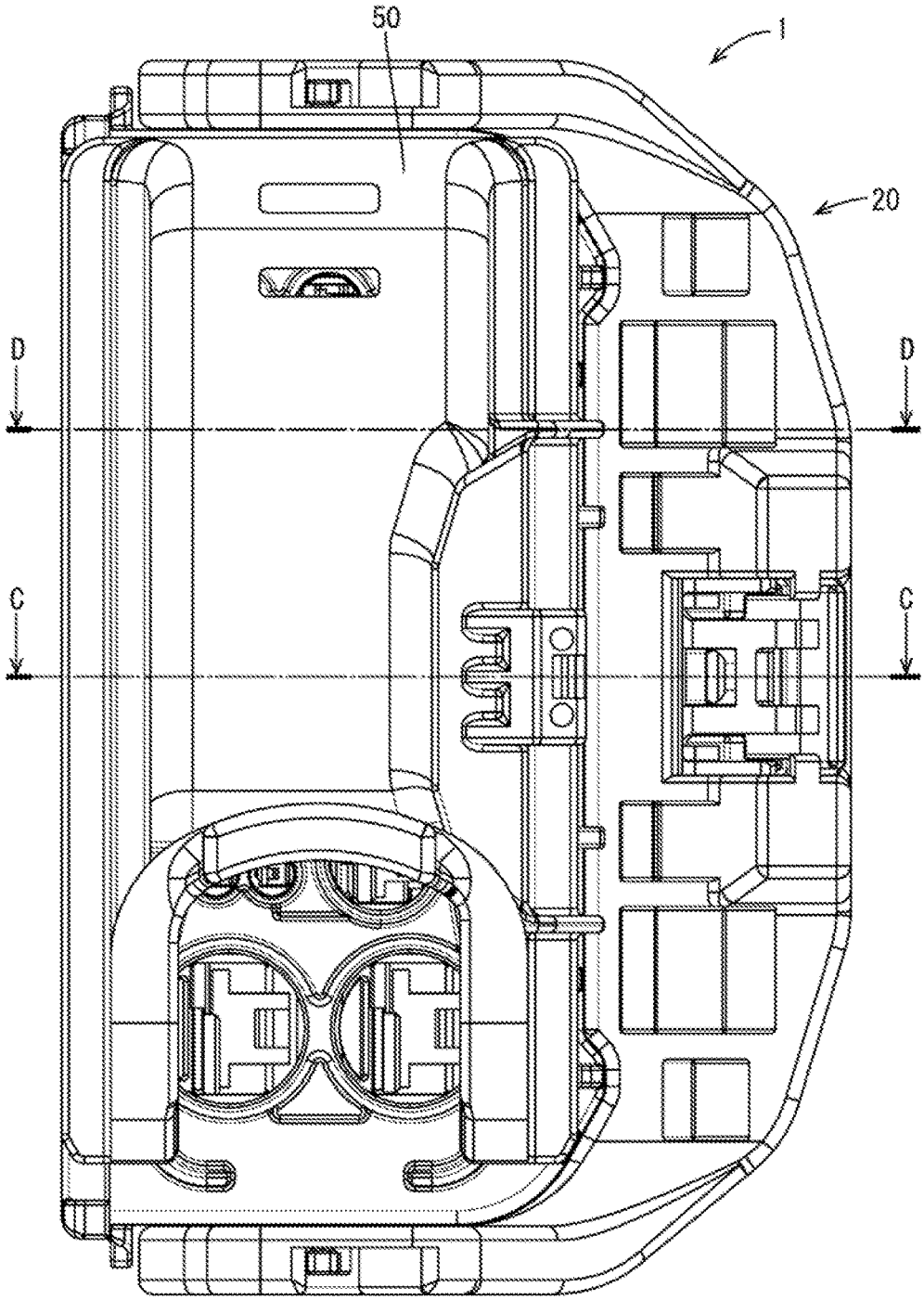
FIG. 9 is a plan view showing the lever-type connector and the mating connector after the completion of the connection in the embodiment.
Figure 11:
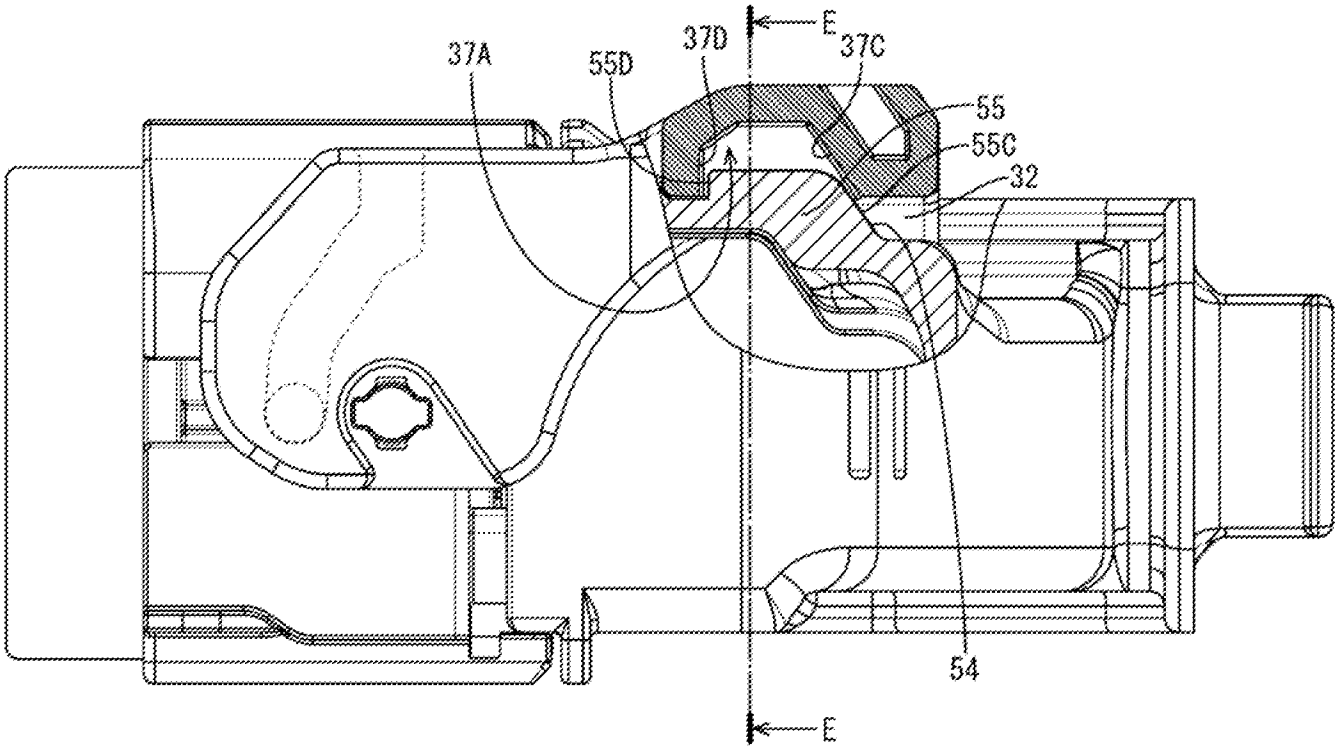
FIG. 11 is a side view partly in section along D-D of FIG. 9 showing the lever-type connector and the mating connector after the completion of the connection in the embodiment.

As shown in FIG. 3, each coupling 36 has recesses (lightening holes 37) for preventing deformation when the lever 20 is formed by injection molding. One lightening hole 37 is at a positioning recess 37A for receiving a positioning portion 55A on the lever 50. The positioning recess 37A is recessed from a surface of the coupling 36 facing the cover 50 when the lever 20 is at a connection end position. Each positioning recess 37A includes a plurality of inner surfaces, as shown in FIGS. 8 and 11, including a first contact surface 37B that is parallel to the cam plate 21, a second contact surface 37C that is perpendicular to the first contact surface 37B, and a third contact surface 37D that is perpendicular to the first contact surface 37B.

Figure 6:
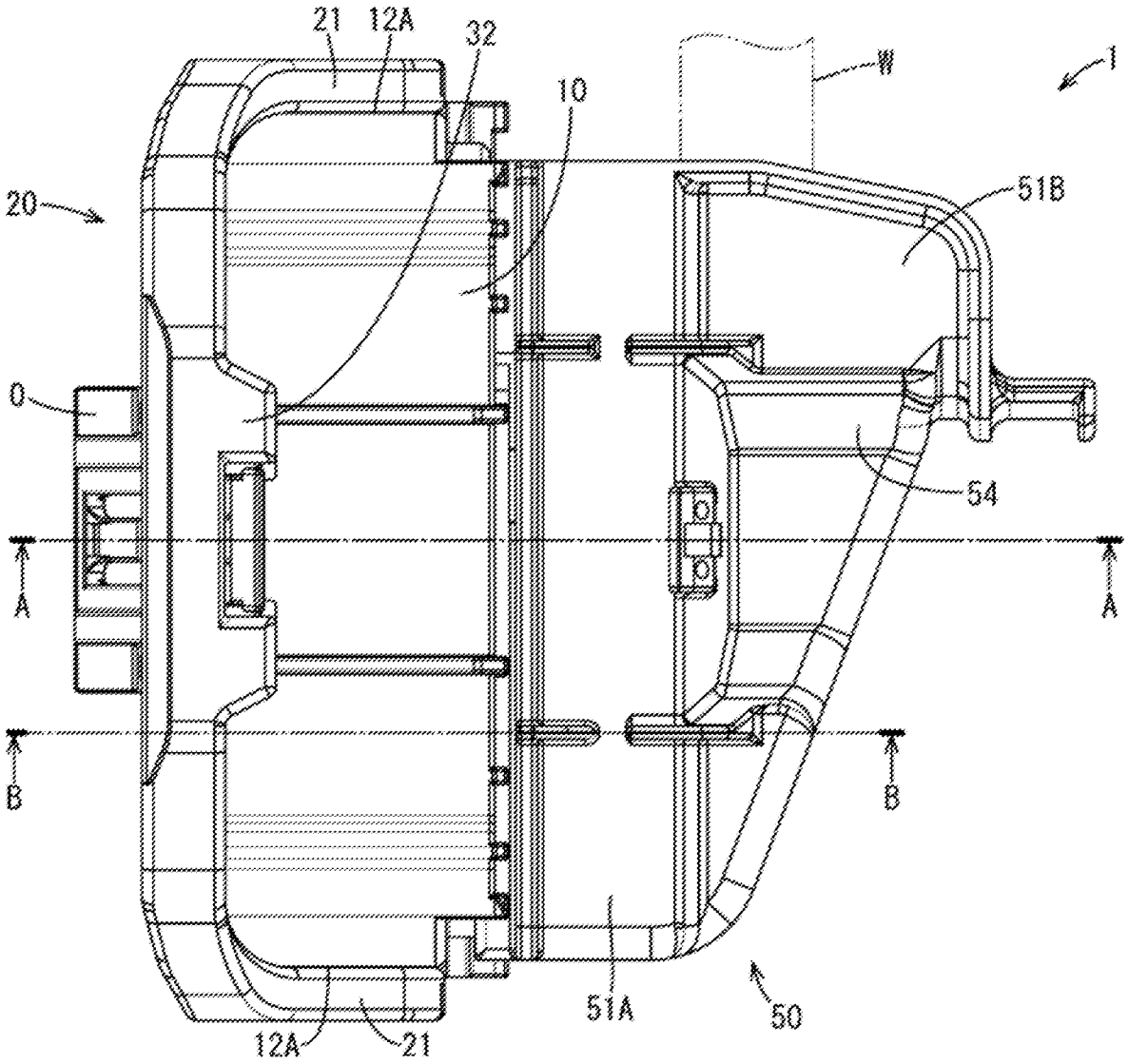
FIG. 6 is a plan view of the lever-type connector of the embodiment.

As shown in FIGS. 1 and 6, the lever 20 is mounted across the connector housing 10 by arranging the two cam plates 21 along the two mounting walls 12A and fitting the support shafts 14 into the bearing holes 22. The lever 20 is supported rotatably between a connection start position (position shown in FIGS. 6, 7 and 8) where the entrance of the cam followers 62 into the cam plates 21 is allowed and the connection end position (position shown in FIGS. 9, 10, 11 and 12) where the mating connector 60 is connected at a proper connection position to the connector housing 10.

As shown in FIG. 3, the lock 32 is thicker than the couplings 36 by including the two bridges 33A, 33B and the lock arm 35 disposed between the bridges 33A, 33B, and the lock 32 projects farther than the couplings 36 toward the cover 50, as shown in FIG. 6.

A detecting body 40 is assembled with the lever 20. The detecting body 40 is made of synthetic resin and includes, as shown in FIG. 7, a substantially U-shaped assembling portion 41, a deflecting piece 42 and a locking claw 43 projecting from the tip of the deflecting piece 42. The assembling portion 41 is to be assembled with the lock 32. The deflecting piece 42 extends from a center of the assembling portion 41 and is deflectable with a coupled position to the assembling portion 41 as a base. The detecting body 40 is displaceable between a detection position (FIG. 10) where the detecting body 40 is accommodated inside the lock space 34 and a standby position (FIG. 7) where the detecting body 40 protrudes from the lock space 34.

[Cover 50]

Figure 5:
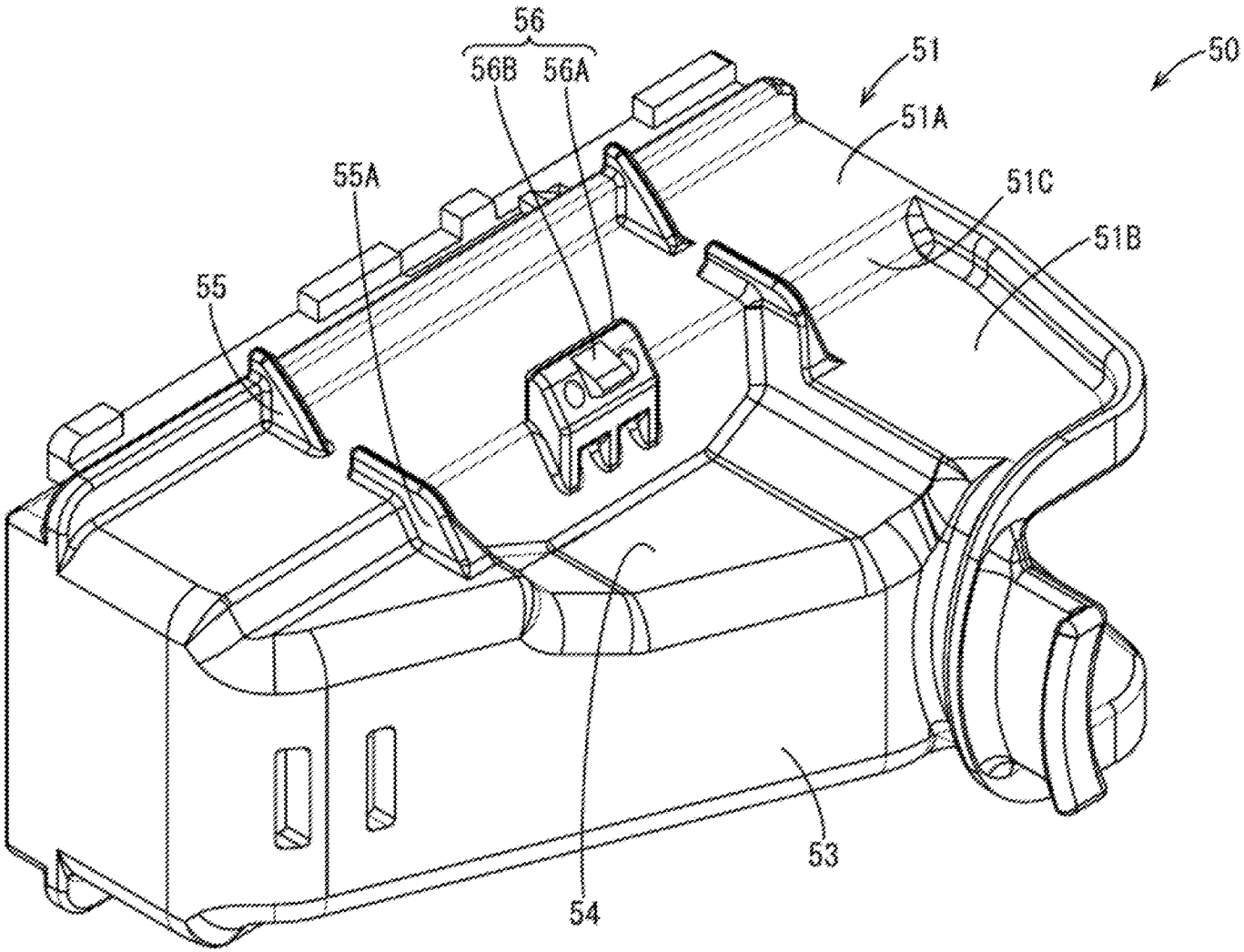
FIG. 5 is a perspective view of a cover of the embodiment.

The cover 50 is assembled with the connector housing 10 for covering the wires W extending from the connector housing 10. The cover 50 is made of synthetic resin and includes, as shown in FIGS. 5 and 7, opposite first and second protection walls 51 and 52 and a bent holding portion 53 coupling the protection walls 51, 52. The first protection wall 51 is disposed along the rotating portion 31 when the lever 20 is at the connection end position. The bent holding portion 53 is substantially L-shaped. The wires W extending from the connector housing 10 are held in a bent state by being disposed along the bent holding portion 53.

As shown in FIGS. 5 and 6, the first protection wall 51 includes a first step 51A adjacent to the connector housing 10 and a second step 51B extending parallel to the first step 51A and located closer to the second protection wall 52 than the first step 51A. A stepped portion 51C links the first and second steps 51A, 51B and has a stepped shape. Further, the second step 51B includes an accommodation recess 54 recessed toward the second protection wall 52 and configured to receive the part of the lock 32 projecting farther than the couplings 36.

Figure 12:
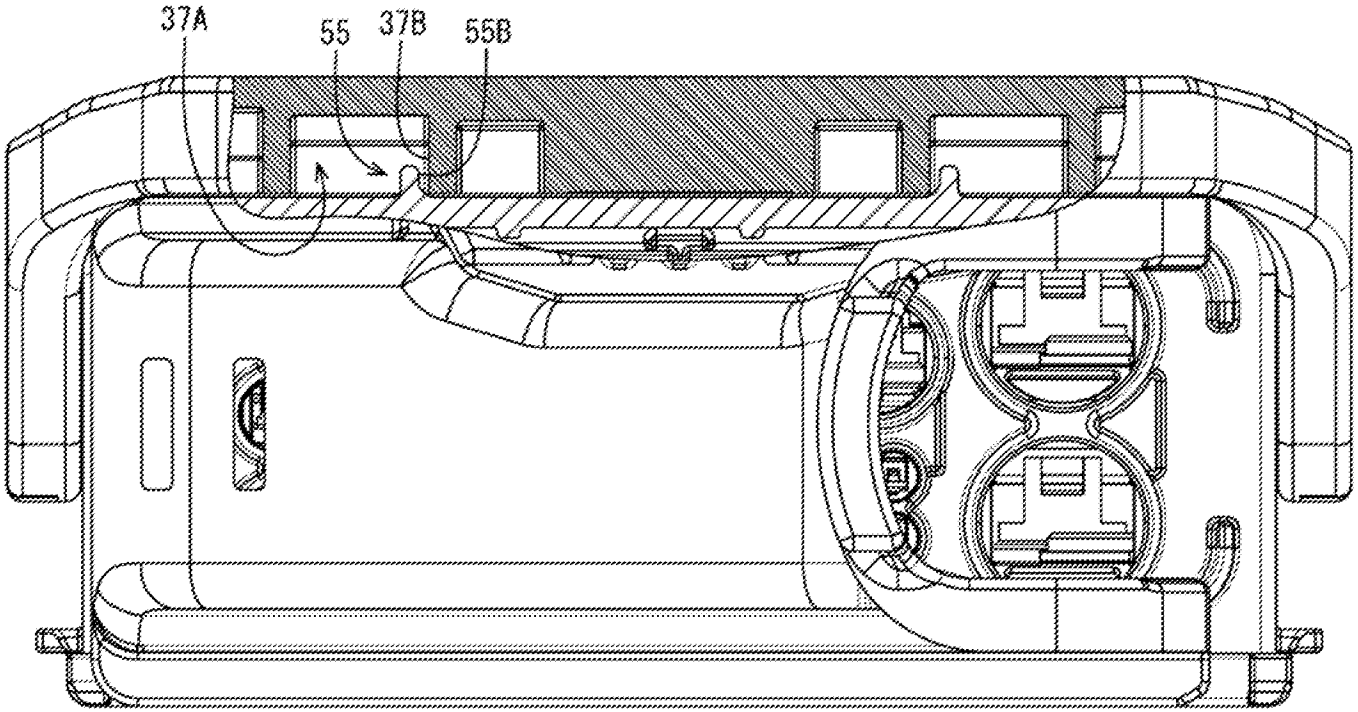
FIG. 12 is a side view partly in section along E-E of FIG. 11 showing the lever-type connector after the completion of the connection in the embodiment.

As shown in FIG. 5, reinforcing ribs 55 project from an outer surface of the cover 50 and reinforce the cover 50. Some of the reinforcing ribs 55 extend from the first protection wall portion 51 and define the positioning portions 55A to be received into the positioning recesses 37A when the lever 20 is at the connection end position. The positioning portion 55A is a plate extending perpendicular to the first protection wall 51. As shown in FIGS. 8, 11 and 12, the positioning portion 55A includes a contact receiving surface 55B in contact with the first contact surface 37B, a first contact receiving edge 55C in contact with the second contact surface 37C and a second contact receiving edge 55D in contact with the third contact surface 37D when the lever 20 is at the connection end position. The first contact receiving edge 55C is inclined to approach the connector housing 10 with distance from the first protection wall 51.

As shown in FIG. 5, the cover 50 includes the lock receiving portion 56. The lock receiving portion 56 includes a lock protrusion 56A projecting from the first protection wall 51 and a lock claw 56B projecting from the lock protrusion 56A.

[Connection of Lever-Type Connector 1 and Mating Connector 60]

The mating connector 60 to be connected to the lever-type connector 1 includes a mating receptacle 61 in the form of a rectangular tube and two the cam followers 62 projecting from outer surfaces of the mating receptacle 61, as shown in FIG. 7.

The mating connector 60 is pulled toward the connector housing 10 by a cam action between the cam grooves 23 and the cam followers 62 as the lever 20 is rotated from the connection start position to the connection end position, thereby assisting a connecting operation.

First, the lever-type connector 1 is fit shallowly to the mating connector 60 with the lever 20 held at the connection start position. Then, as shown in FIG. 7, the cam followers 62 enter the cam grooves 23.

Subsequently, the lever 20 is rotated from the connection start position to the connection end position. As the lever 20 is rotated, the connector housing 10 is pulled relatively toward the mating connector 60 by the cam action based on the engagement of the cam followers 62 and the cam grooves 23. When the lever 20 approaches the connection end position, the lock arm 35 is deflected while riding on the lock claw 56B.

Figure 10:
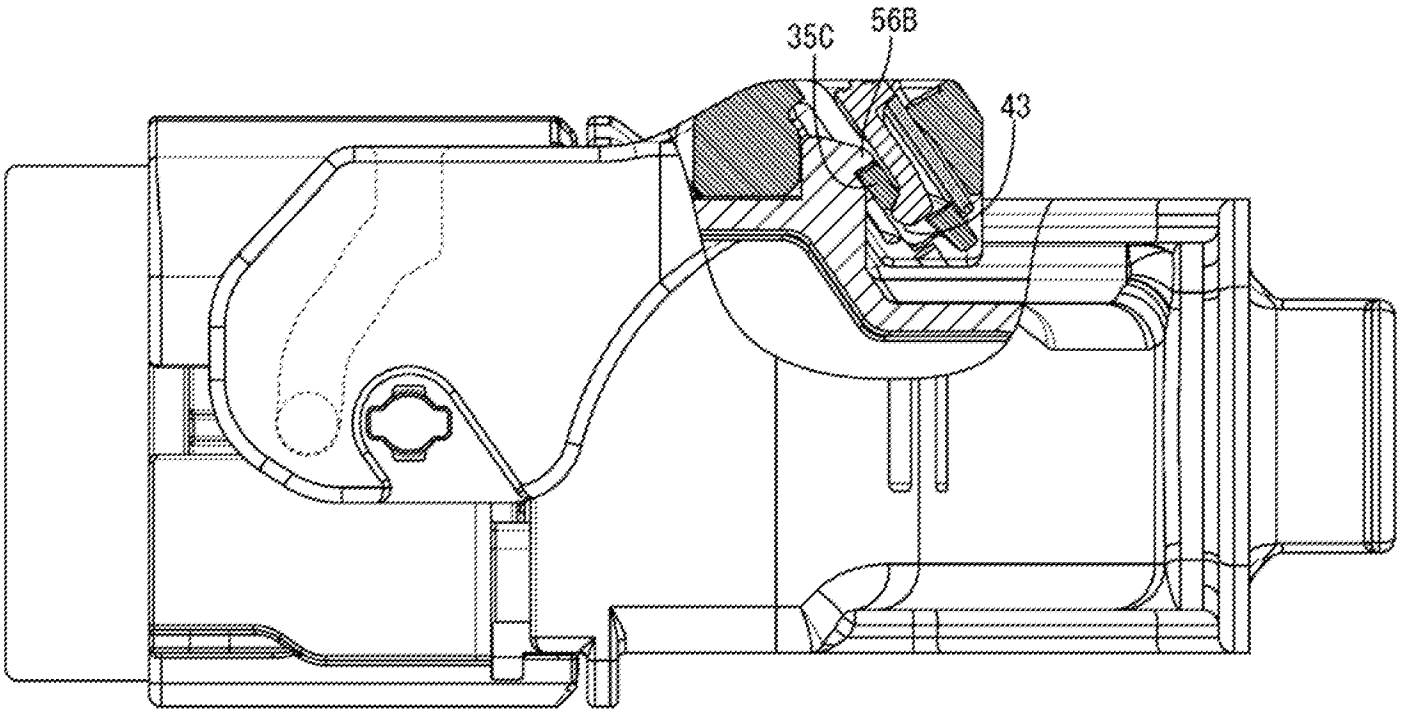
FIG. 10 is a side view partly in section along C-C of FIG. 9 showing the lever-type connector and the mating connector after the completion of the connection in the embodiment.

The connector housing 10 reaches the proper connection position with respect to the mating connector 60 when the lever 20 reaches the connection end position, as shown in FIG. 10. Further, the lock arm 35 rides over the lock claw 56B and resiliently returns. Thus, the lock beam 35C engages the lock claw 56B to hold the lever 20 at the connection end position. Further, the two positioning portions 55A respectively enter the corresponding positioning recesses 37A. As shown in FIG. 12, the cover 50 is positioned in a direction perpendicular to the directions toward and away from the connector housing 10 by the contact of the first contact surfaces 37B with the contact receiving surfaces 55B. As shown in FIG. 11, the second contact surfaces 37C contact the first contact receiving edges 55C to position the cover 50 in directions toward and away from the connector housing 10.

The cover 50 may be misaligned with respect to the connector housing 10, for example, due to assembling errors when assembling the cover 50 with the connector housing 10, restoring forces of the wires W bent along the bent holding portion 53 or the like. In this situation, the lever 20 cannot be held at the predetermined connection end position and the connecting operation may not be completed smoothly. However, the first contact surfaces 37B contact the contact receiving surfaces 55B when the cover 50 is at the connection end position to position the cover 50 in the direction (lateral direction of FIG. 12) perpendicular to the directions toward and away from the connector housing 10. Further, the second contact surfaces 37C contact the first contact receiving edges 55C, and the third contact surfaces 37D contact the second contact receiving edges 55D to position the cover 50 in the directions toward and away from the connector housing 10 (lateral direction of FIG. 11). As just described, the misalignment of the cover 50 with respect to the connector housing 10 is suppressed in two directions perpendicular to each other. In this way, the lever 20 is held at the predetermined connection end position, and the connecting operation is completed smoothly.

Particularly, the wires W extending from the connector housing 10 are held in the bent state by being disposed along the bent holding portion 53. Thus, restoring forces of the bent wires W act in a direction to separate the cover 50 from the connector housing 10. However, the second contact surfaces 37C contact the first contact receiving edges 55C to position the cover 50 in the directions toward and away from the connector housing 10 to suppress misalignment of the cover 50 with respect to the connector housing 10.

Further, the first contact receiving edge 55C is inclined to approach the connector housing 10 with distance from the first protection wall 51, and the second contact surface 37C is inclined away from the connector housing 10 toward the protection wall 51 when the lever 20 is at the connection end position. In this way, even if the cover 50 is misaligned slightly in the direction away from the connector housing 10, the inclination of the second contact surfaces 37C and the first contact receiving edges 55C guide the cover 50 to a proper assembling position as the lever 20 is rotated. In this way, the lever 20 is held at the predetermined connection end position, and the connecting operation is completed smoothly.

Furthermore, when the lever 20 is at the connection end position, the part of the lock 32 projecting farther than the couplings 36 is accommodated inside the accommodation recess 54, as shown in FIG. 11. In this way, a projecting amount of the lever 20 at the connection end position from the cover 50 can be reduced and the entire lever-type connector 1 is reduced in size as compared to the case where the accommodation recess 54 is not provided.

The detecting body 40 is pushed from the standby position to the detection position after the lever 20 is held at the predetermined connection end position. The locking claw 43 rides on the lock claw 56B and the lock beam 35C to deflect the deflecting piece 42. The deflecting piece 42 resiliently returns when the locking claw 43 rides over the lock claw 56B and the lock beam 35C, and the locking claw 43 engages the lock beam 35C. In this way, the lever 20 is locked at the connection end position to complete the connection of the lever-type connector 1 and the mating connector 60.

[Functions and Effects]

As described above, according to this embodiment, the lever-type connector 1 is provided with the connector housing 10 including the wire holding portion 11. The wires W have end parts held in the wire holding portion 11 and extend from the connector housing 10. The lever 20 is assembled with the connector housing 10 and is rotatable from the connection start position to the connection end position, and the cover 50 for covering the wires W extends from the connector housing 10 by being assembled with the connector housing 10. The cover 50 includes the positioning portions 55A, and the lever 20 includes the first contact surfaces 37B and the second contact surfaces 37C for positioning the cover 50 at a proper mounting position by contacting the positioning portions 55A when the lever 20 is at the connection end position.

If the cover 50 is misaligned with respect to the connector housing 10, the lever 20 may not be held at the predetermined connection end position and the connecting operation may not be completed smoothly due to the interference of the cover 50 with the lever 20 or the like. According to the above configuration, if the lever 20 is rotated from the connection start position to the connection end position, the positioning portions 55A contact the first and second contact surfaces 37B, 37C to position the cover 50 at the proper mounting position. Thus, the lever 20 is held at the connection end position and, the connecting operation is completed smoothly.

Further, the lever 20 includes the lock 32, and the cover 50 includes the lock receiving portion 56 to be locked by the lock 32. The lock 32 and the lock receiving portion 56 may be misaligned and unable to be locked to each other. Thus, smoothly completing the connecting operation may be impossible if the cover 50 is misaligned with respect to the connector housing 10. However, the lever-type connector 1 described herein has the positioning portions 55A, the first contact surfaces 37B and the second contact surfaces 37C for positioning the cover 50 and smoothly completing the connecting operation.

The cover 50 includes the accommodation recess 54 for accommodating the lock 32 inside when the lever 20 is at the connection end position. Accordingly, the projecting amount of the lever 20 at the connection end position from the cover 50 can be reduced, and the entire lever-type connector 1 can be reduced in size as compared to the case where the accommodation recess 54 is not provided.

The cover 50 includes the bent holding portion 53 for holding the wires W in the bent state. When the cover 50 holds the wires W in the bent state in this way, the restoring forces of the wires W can misalign the cover 50. However, the positioning portions 55A, the first contact surfaces 37B and the second contact surfaces 37C position the cover 50 at the proper mounting position so that the connecting operation can be completed smoothly.

The positioning portion 55A is one of the reinforcing ribs 55 projecting from the outer surface of the cover 50. According to this configuration, the reinforcing rib 55 arranged on the cover 50 for reinforcement can be used as the positioning portion 55A. Thus, a drastic design change of the cover 50 is unnecessary.

The first and second contact surfaces 37B, 37C are the inner surfaces of the positioning recess 37A, which is one of the lightening holes 37 recessed from the surface of the lever 20. According to this configuration, the inner surfaces of the lightening hole 37 provided to prevent deformation when the lever 20 is formed by injection molding can be used as the first and second contact surfaces 37B, 37C. Thus, a drastic design change of the lever 20 is unnecessary.

The positioning portion 55A contacts the first contact surface 37B and the second contact surface 37C disposed perpendicular to the first contact surface 37B. According to this configuration, misalignment is suppressed in two directions perpendicular to each other.

Other Embodiments

The configurations of the positioning portion and a positioning receiving portion are not limited to those of the above embodiment. For example, the positioning portion may be an inner surface of a recess provided in the cover and the positioning receiving portion may be a protrusion provided on the lever and configured to come into contact with the inner surface of the recess.

Misalignment of the cover is suppressed in two directions perpendicular to each other by the first and second contact surfaces 37B, 37C in the above embodiment. However, certain effects are achieved if the misalignment of the cover is suppressed in one of the directions.

The cover may be a member for covering the wires in a straight state without including the bent holding portion for holding the wires in the bent state.

LIST OF REFERENCE SIGNS

1: lever-type connector
10: connector housing
11: wire holding portion
12: receptacle
12A: mounting wall
13: receiving groove
14: support shaft
20: lever
21: cam plate
22: bearing hole
23: cam groove
23E: entrance opening
31: rotating portion
32: lock
33A, 33B: bridge
34: lock space
35: lock arm
35A: arm
35B: locking portion
35C: lock beam
36: coupling
37: lightening hole
37A: positioning recess
37B: first contact surface (positioning receiving portion, one contact surface)
37C: second contact surface (positioning receiving portion, another contact surface)
37D: third contact surface (positioning receiving portion, another contact surface)
40: detecting body
41: assembling portion
42: deflecting piece
43: locking claw
50: cover
51: first protection wall
51A: first step
51B: second step
51C: stepped portion
52: second protection wall
53: bent holding portion
54: accommodation recess
55: reinforcing rib
55A: positioning portion
55B: contact receiving surface
55C: first contact receiving edge
55D: second contact receiving edge
56: lock receiving portion
56A: lock protrusion
56B: lock claw
60: mating connector
61: mating receptacle
62: cam follower
W: wire

What is claimed is:

1. A lever-type connector, comprising:

a connector housing including a wire holding portion having opposite front and rear ends;

a wire having an end part held in the wire holding portion, the wire extending from the rear end of the wire hold portion of the connector housing;

a lever to having a rotating portion and first and second cam plates extending from opposite ends of the rotating portion, the cam plates being assembled rotatably with the connector housing and the lever being rotatable from a connection start position to a connection end position where the rotating portion is rearward of the wire holding portion; and a cover assembled with the connector housing for covering the wire extending from the rear end of the wire holding portion of the connector housing, wherein:

the cover includes a lock receiving portion and a positioning portion, and the rotating portion of the lever includes a lock to be locked to the lock receiving portion of the cover when the lever is at the connection end position, and a positioning receiving portion for positioning the cover at a proper mounting position by contacting the positioning portion of the cover when the lever is at the connection end position.

2. The lever-type connector of claim 1, wherein the cover includes an accommodation recess for accommodating the lock inside when the lever is at the connection end position.

3. The lever-type connector of claim 2, wherein the cover includes a bent holding portion for holding a portion of the wire rearward of the wire holding portion in a bent state.

4. The lever-type connector of claim 3, wherein the positioning portion is a reinforcing rib projecting from an outer surface of the cover.

5. The lever-type connector of claim 4, wherein the positioning receiving portion is an inner surface of a lightening hole recessed in a surface of the rotating portion of the lever, the positioning portion of the cover being received in the lightening hole in the rotating portion of the lever when the lever is at the connection end position.

6. The lever-type connector of claim 5, wherein the positioning receiving portion includes a first contact surface configured to contact the positioning portion when the lever is at the connection end position and a second contact surface arranged perpendicular to the first contact surface and configured to contact the positioning portion when the lever is at the connection end position.

7. The lever-type connector of claim 1, wherein the cover includes a bent holding portion for holding a portion of the wire rearward of the wire holding portion in a bent state.

8. The lever-type connector of claim 1, wherein the positioning portion is a projection projecting from an outer surface of the cover.

9. The lever-type connector of claim 1, wherein the positioning receiving portion is an inner surface of a lightening hole recessed in a surface of the rotating portion of the lever, the positioning portion of the cover being received in the lightening hole in the rotating portion of the lever when the lever is at the connection end position.

10. The lever-type connector of claim 9, wherein the positioning receiving portion includes a first contact surface configured to contact the positioning portion when the lever is at the connection end position and a second contact surface arranged perpendicular to the first contact surface and configured to contact the positioning portion when the lever is at the connection end position.

11. The lever-type connector of claim 1, wherein the rotating portion of the lever engages over the positioning portion of the cover when the lever is at the connection end position.

* * * * *